US007918743B2

(12) United States Patent
Martens

(10) Patent No.: US 7,918,743 B2
(45) **Date of Patent: *Apr. 5, 2011**

(54) ADJUSTABLE PUTTING GREEN FOR GOLF PRACTICE

(76) Inventor: David J. Martens, Abbotsford (CA)

( * ) Notice: Subject to any disclaimer, the term of this patent is extended or adjusted under 35 U.S.C. 154(b) by 0 days.

This patent is subject to a terminal disclaimer.

(21) Appl. No.: 12/312,562

(22) PCT Filed: Nov. 20, 2006

(86) PCT No.: PCT/CA2006/001891

§ 371 (c)(1),
(2), (4) Date: Jun. 9, 2009

(87) PCT Pub. No.: WO2008/061333

PCT Pub. Date: May 29, 2008

(65) Prior Publication Data

US 2010/0075771 A1 Mar. 25, 2010

(51) Int. Cl.
*A63B 69/36* (2006.01)

(52) U.S. Cl. ..... 473/160

(58) Field of Classification Search ..... 473/160, 473/161, 279

See application file for complete search history.

(56) References Cited

U.S. PATENT DOCUMENTS

| | | | | | |
|---|---|---|---|---|---|
| 2,465,418 | A | * | 3/1949 | Baker | 473/160 |
| 3,595,581 | A | * | 7/1971 | Anderson et al. | 473/161 |
| 3,601,407 | A | * | 8/1971 | Lorrance | 473/160 |
| 4,211,417 | A | | 7/1980 | Brown | |
| 4,222,568 | A | * | 9/1980 | Russo | 473/160 |
| 4,247,112 | A | * | 1/1981 | Del Raso | 473/153 |
| 4,978,127 | A | * | 12/1990 | Juel, Jr. | 473/160 |
| 4,988,106 | A | | 1/1991 | Coonrod | |
| 5,002,280 | A | | 3/1991 | Hines | |
| 5,172,914 | A | * | 12/1992 | Primerano | 473/171 |
| 5,390,926 | A | | 2/1995 | Hanson et al. | |
| 5,441,265 | A | | 8/1995 | Codlin | |
| 5,564,706 | A | | 10/1996 | Eller et al. | |
| 5,855,522 | A | | 1/1999 | Bevan | |
| 6,050,901 | A | * | 4/2000 | Davis | 473/160 |
| 6,179,721 | B1 | | 1/2001 | Bevan | |
| 6,338,682 | B1 | | 1/2002 | Torchia et al. | |

(Continued)

FOREIGN PATENT DOCUMENTS

| | | | |
|---|---|---|---|
| JP | 2005319237 | A | 11/2005 |
| JP | 2006289002 | A | 10/2006 |

*Primary Examiner* — Mark S Graham
(74) *Attorney, Agent, or Firm* — Todd N. Hathaway

(57) ABSTRACT

A practice putting green that is adjustable to provide a playing surface having a variety of contours. The assembly is formed of a plurality of narrow transverse support members that are arranged as segments in side-to-side relationship to define an elongate playing path. Carpet, artificial turf or other flexible material is placed atop the support members to form the playing surface. Inwardly facing wedges are mounted under the ends of the support members and are slid from side-to-side so as to selectively tilt the members and adjust the contour of the playing surface. The wedges on each segment are joined by a transverse rod so that both will move simultaneously in response to pressure on one of the wedges. The support members have a tray-shaped configuration with upwardly extending end walls, so that in combination they define an elongate channel. The layer of pliable material is received in the channel so that the edges thereof engage the walls of the channel on either side so as to hold the support members against shifting out of alignment from side-to-side.

20 Claims, 9 Drawing Sheets

U.S. PATENT DOCUMENTS 6,964,615 B2 11/2005 Lee
7,195,563 B1 * 3/2007 Martens ..... 473/160
2004/4013799 7/2004 Chang
2005/0049070 A1 * 3/2005 Lee et al. ..... 473/278

* cited by examiner

ADJUSTABLE PUTTING GREEN FOR GOLF PRACTICE

BACKGROUND a. Field of the Invention

The present invention relates generally to practice greens for use in the game of golf, and, more particularly, to a practice green having an upper surface that is adjustable to a variety of contours.

b. Related Art

Artificial greens are well known for practicing one's golf skills, and are a common fixture of homes, offices, course club houses, and "19$^{th}$ Holes". Typically, such practice greens have a surface covered with carpet or artificial turf and one or more holes into which the ball is putted.

Although traditional practice greens are useful to a degree, their benefits and enjoyability are limited by the fact that in most cases they are static structures which cannot be adjusted to provide added challenge or an element of variety. For example, many prior practice greens are simply long, flat surfaces, which provide no challenge above a certain level. In other cases practice greens have been made that incorporate certain obstacles, such as a small "sand trap" or "water hazard", but while they might add some challenge or entertainment value these features bear little or no resemblance to the conditions the golfer will encounter on a green on an actual course.

On actual putting greens, of course, the greatest challenge is usually provided by the uneven contour, with various slopes, breaks, swales, ridges, roll-overs and so on, so that one cannot simply putt the ball straight towards the hole and expect it to go in. In many courses these features are intentionally designed into the greens, and it is a critical skill of a master golfer to be able to "read" these contours so as to be able to effectively compensate for them in making a successful putt. In point of fact, the slopes and contours of the greens of many major golf courses are cataloged and studied in depth by both professional and amateur players.

Prior forms of practice greens have had very little ability to simulate these features. For example, U.S. Pat. No. 6,146,284 shows a practice putting green having panels that are supported on adjustable legs. While this does allow the slope to be adjusted, it does so only in a gross sense and there is little or no capability to develop subtle features, such as small ridges, swales and so on. Moreover, reliance on the individual height-adjustable legs means that adjustment is tedious, and stability and long-term durability are doubtful. A more basic variant on the same theme is shown in U.S. Pat. No. 5,863,256, in which the panels are supported from side rails having height adjusting screws. U.S. Pat. No. 5,390,925 shows a device in which the angle of the panel is adjusted by rotating polygonal supports at its corners.

Others have taken the expedient of simply placing a mound under the carpet or artificial turf, but this obviously offers little flexibility or adjustment, at least without having to provide (and store) large number of different mounds, ridges, and pieces having other shapes.

Accordingly, there exists a need for a practice putting green having a surface that is readily adjustable to a wide range of contours. Furthermore, there exists a need for such a putting green that permits varied and subtle contours to be formed within the overall lie of the surface. Still further, there exists a need for such a practice green assembly that is simple and convenient to adjust. Still further, there exists a need for such a practice green apparatus that employs a support mechanism that is both durable and stable in use.

SUMMARY OF THE INVENTION

The present invention has solved the problems cited above, and is a practice putting green that is adjustable to provide a playing surface having a variety of contours. Broadly, this comprises a plurality of transversely extending support segments arranged in side-by-side relationship so as to define an elongate playing path; at least one flexible layer placed over the segments so as to form a playing surface along the playing path; and means for tilting the support segments individually in a direction lateral to the playing path, so that the flexible layer that is supported thereby can be selectively raised or lowered from one side to the other so as to provide the playing path with a variety of contours.

Each of the support segments may comprise a transversely extending support tray having an upper surface for engaging the overlying layer of resiliently flexible material, and first and second wedge members having inwardly angled inclined surfaces in sliding engagement with opposite ends of the tray member. The wedge members may be commonly mounted to a transversely extending rod, so that the wedge members will slide together simultaneously in response to pressure on an outer end of one of the wedge members. The rod may pass through a cooperating bore in a center block, and stop pins may be mounted on the rod for reacting against side faces of the center block so as to limit side-to-side motion of the wedge members. The center block may be pivotedly or fixedly mounted to the tray member.

Each of the tray members may comprise a flat, narrow panel having upstanding wall portions at its ends for defining a shallow, upwardly facing section of channel, so that when a plurality of the segments are placed in side-to-side relationship the channel sections cooperate define an elongate channel for receiving the layer of flexible material therein. The layer of flexible material may have a width selected so that the edges thereof fit closely within the upstanding walls of the tray members, so that the material prevents the tray members from sliding from side to side as the wedge members are adjusted.

The at least one layer of flexible material may comprise a layer of resiliently flexible cushioning material overlain by a layer of carpet or artificial turf material.

These and other features and advantages of the present invention will be better understood by reading of the following detailed description with reference to the accompanying drawings, in which like reference numerals will refer to like structures.

DETAILED DESCRIPTION

Figure 1:
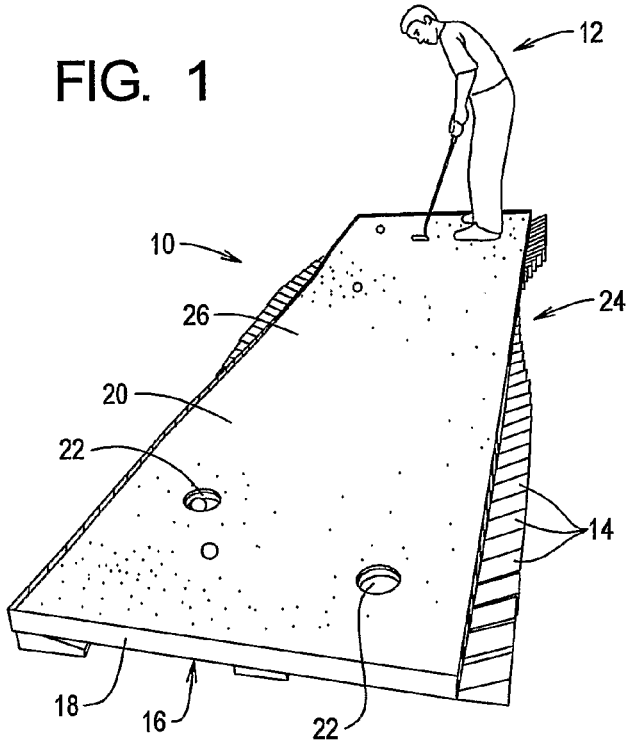
FIG. 1 is a perspective view of an adjustable practice green assembly in accordance with the present invention, showing this being used by putting across an undulating contour that is formed on the upper surface of the apparatus.

FIG. 1 shows an adjustable putting assembly 10 in use by a golfer 12. As can be seen in FIG. 1, the practice green assembly is composed of a plurality of transversely extending support segments 14 arranged adjacent to one another. As will be described in greater detail below, each of the segments includes a tray member that, when placed next its neighbors, forms a section of an elongate channel 16. The channel supports a layer of resiliently flexible, slightly compressible cushioning material 18, such as high-density foam, overlain by a thinner layer of carpet 20 or artificial turf material. Cups or holes 22 are formed in the carpet and cushion material near one end of the assembly, and are preferably sized to correspond to those on a regulation course.

Figure 2:
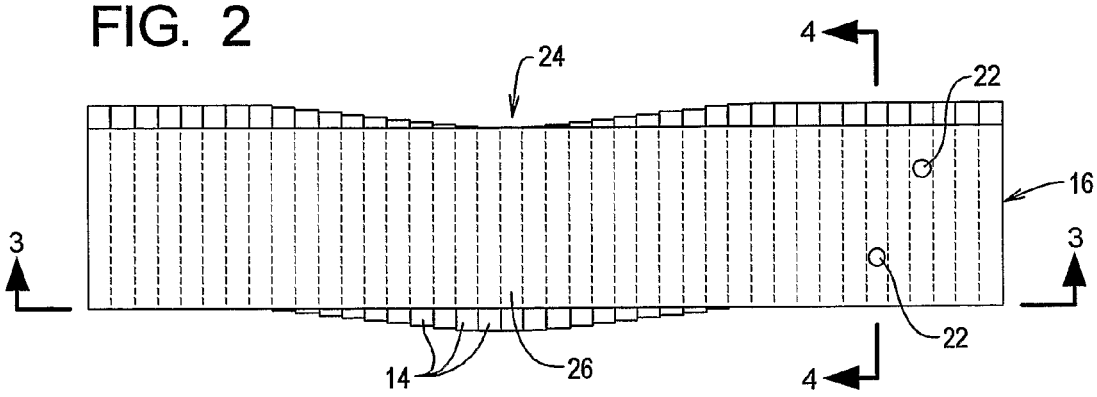
FIG. 2 is a top, plan view of the practice green assembly of FIG. 2, showing the segmented structure thereof in greater detail and illustrated in the manner in which the contour of the upper surface of the assembly is adjusted by shifting the individual segments from side to side.

As will be described in greater detail below, the height and slope of the putting surface is adjustable at each segment by sliding the wedge members of the segments from side-to-side, i.e., in a direction transverse to the long axis of the assembly. For example, FIG. 1 shows a group of segments 14 having been shifted to the right (from the perspective of the golfer) to create a gentle swale 26 to the right in the area 24 between the golfer and the target holes 22. As can be seen in FIG. 2, the narrow width of the support segments 14 enables these to be adjusted by slight amounts relative to one another, thus creating very realistic and subtle contours that effectively mimic those of a natural putting green.

Figure 7:
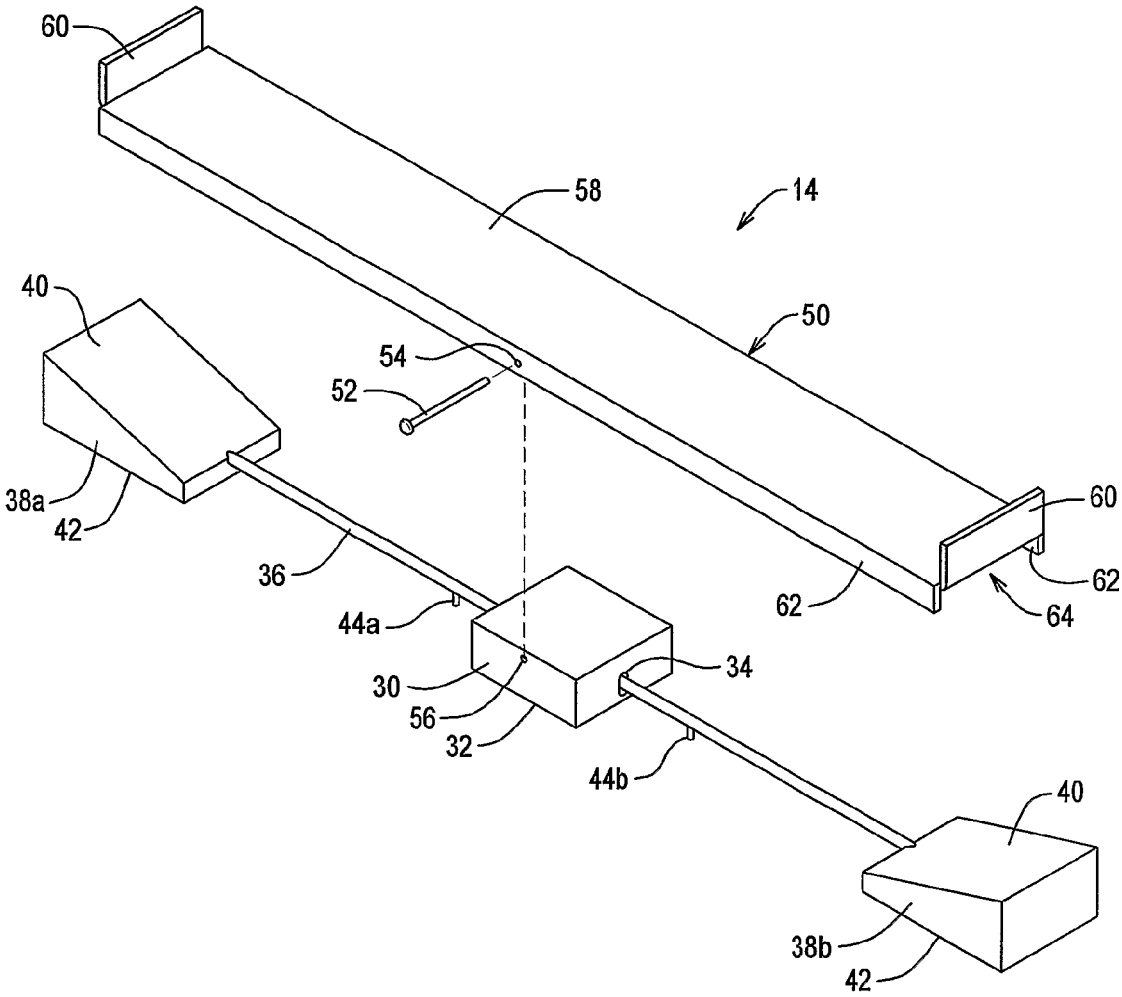
FIG. 7 is a perspective, exploded view of an individual one of the segment assemblies of the practice green of FIGS. 1-6, showing the components thereof in greater detail, and in particular the relationship of the sliding edge members and pivoting support plate to the central support member of the segment assembly.

FIG. 7 shows the construction of the individual support segments 14 in greater detail. As can be seen, each segment assembly includes a base block 30 having a lower surface 32 for resting on the floor or ground. The base block includes a transverse bore 34, with a rod member 36 passing through the bore in reciprocating, sliding relationship thereto. First and second wedge members 38*a*, 38*b* are mounted to the outer ends of the rod member 36, and each includes an inwardly angled upper surface 40 and horizontal bottom surface 42, the latter being in co-planar relationship with the bottom surface 32 of the central support block so that all three will rest on the floor/ground simultaneously. First and second depending stop pins 44*a*, 44*b* are mounted to the rod member on opposite sides of the support block 30, and serve to limit the lateral range of motion of the rod and wedge members.

The wedge member 38*a*, 38*b* and central support block 30 are suitably formed of rigid plastic material (e.g., extruded or molded plastic) having low compressibility and good strength and wear characteristics, while the rod member 36 is suitably formed of metal (e.g., steel or aluminum).

The tray member 50, in turn, is pivotedly mounted to the center block 30 by a pivot pin 52 that passes through cooperating bores 54, 56. The tray member has a flat, comparatively narrow panel 58 that spans the width of the segment assembly and that is bounded on its ends (i.e., the ends that will be on the left and right sides of the assembly) by upstanding wall portions 60. Depending walls or flanges 62 border the lateral edges of the panel 58, in turn, and include the bore 54 for the pivot pin 52. The width between the depending flanges 62 is just slightly greater than the width of the center block and wedge members 30 and 38*a*, 38*b*; the depending flanges 62 consequently define a channel 64 that fits over and receives the underlying plastic supports as the tray member rocks about pivot pin 52. The tray member is suitably formed of heavy gauge aluminum or steel sheet metal, cut and bent to form the upwardly and downwardly extending wall portions thereof.

Figure 3:
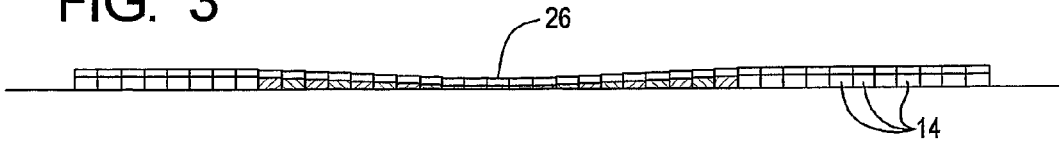
FIG. 3 is a side, cross sectional view of the practice green apparatus of FIGS. 1-2, taken along line 3-3 in FIG. 2, illustrating the manner in which the relative positions of the sloped portions of individual segments dictate the height and contour of the upper surface of the assembly.
Figure 4:
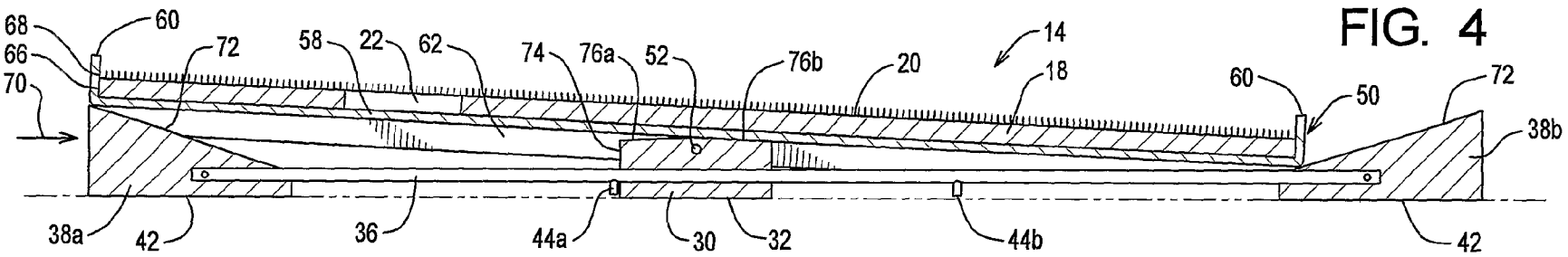
FIGS. 4-6 are end, cross sectional views of the practice green assembly of FIGS. 1-3, taken along line 4-4 in FIG. 2, showing the adjustable segments of the assembly in greater detail and illustrating the manner in which the opposing wedge members thereof adjust both the height and angle of the upper panel of the segment and the overlying surface material as they are shifted from side-to-side relative to one another.
Figure 5:
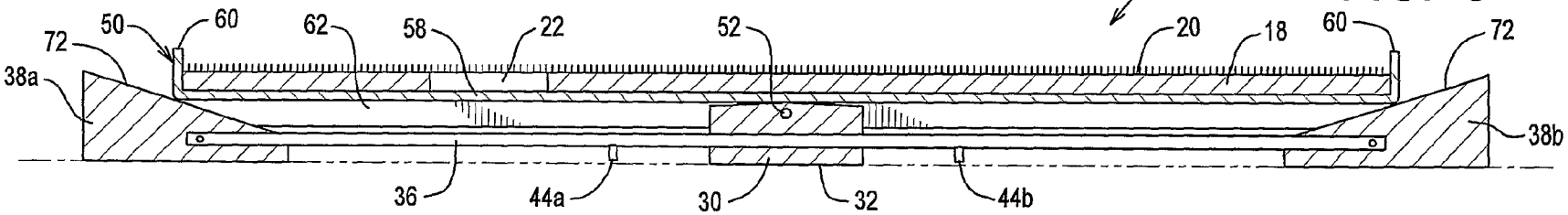
Figure 6:
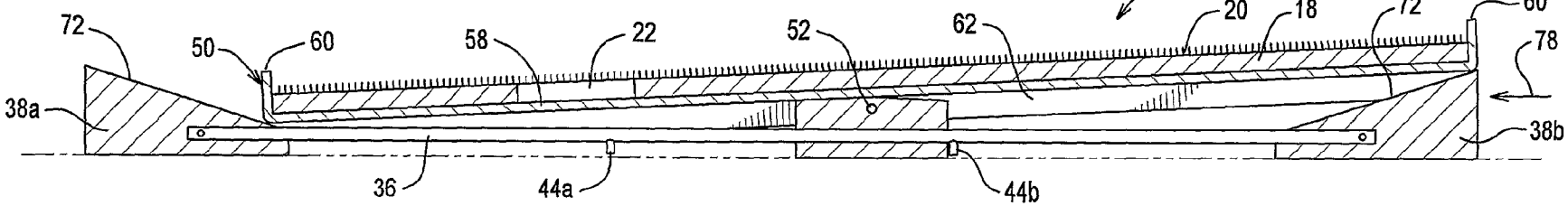

In end view (i.e., looking along the long axis of the assembly, as shown in FIGS. 1-3), the panel 58 and wall members 60 define a shallow, outwardly facing U-shaped channel section, so that when the segments are placed in side-by-side relationship they form a elongate, continuous channel into which the pad and turf layers 18, 20 are placed. As can be seen in FIGS. 4-6, the edges 66, 68 of the pad and carpet layers 18, 20 fit closely within the channel and butt up against the end walls 60 of the trays. Since the pliable pad and carpet layers are both continuous in the longitudinal direction, the engagement between the edges of these layers and the upstanding walls 60 of the tray sections prevents the segments from shifting out of line as the underlying supports are slid to one side or the other.

Accordingly, when the support assembly is slid to the right, as indicated by arrow 70 in FIG. 4, the tray section 50 remains in place while wedge members 38*a*, 38*b* slide to the right. As this happens, the left end of the tray member slides up the inclined face 72 of the left wedge member 38*a* while the opposite end of the tray member slides down the corresponding face of the other wedge member 38*b*, imparting a downward slope to the right to both the tray member and the overlying pad/turf layers. The stop pin 44*a* on the left end of the rod member 36 contacts the left side 74 of the center block to limit the motion to a predetermined range, while the upper end of the support block is provided with angled top surfaces 76*a*, 76*b* to likewise accommodate the tilting motion of the tray member. When the wedge members are pushed back to a centered position, as shown in FIG. 5, the two edges of the tray member are likewise centered on the inclined faces 72 so that the tray member and overlying pad and turf layers assume a level orientation. Similarly, when the wedge members are pressed to the left, as indicated by arrow 78 in FIG. 6, the edges of the tray member slide along the inclined surfaces 72 to assume an angled orientation opposite that in FIG. 4.

Since, as noted above, the individual segment assemblies are relatively narrow (e.g., 15-30 cm wide), very subtle adjustments can be made to the contour of the playing surface by sliding each segment a lesser or greater extent relative to its neighbors. Moreover, the segments can be slid first to one side and then the next along the length of the assembly, thus providing a variety of swales, ridges, and other contours along the path between the player and the cup. In some embodiments a linkage or connection may be provided between the rods of adjoining segments, or between the adjoining wedge members themselves, such that after a predetermined amount of travel (e.g., 2-5 cm) the adjoining wedge members begin to move together with that which is being pressed, thus avoiding pronounced displacement between adjoining segments and rendering it easier to achieve a smooth contour.

In practice, adjusting the contours of the assembly is very easily accomplished by the player by simply sliding his foot along the floor and pressing against the ends of the wedge members as he does so. A gently curved contour, such as that shown in FIGS. 1-3, is thus very quickly and easily achieved, and the player can make any desired corrections or adjustments by simply walking to the other side of the assembly and pressing his foot against the appropriate segments. Moreover, because each tray member is supported at both ends by the wedge members and in the middle by contact with the central block member (along its center ridge or the angled top surfaces 76*a*, 76*b*), the overall assembly is extremely rigid and stable when walked upon, and is also durable and long-lasting, even under conditions of heavy use.

Furthermore, the use of multiple, identical support segments means that the assembly can be built up to any desired length; in the embodiment that is illustrated in FIGS. 1-3, forty segments are used to construct a green assembly that is approximately 8.5 m long and 1.7 m wide, but it will be understood that assemblies having any desired dimensions can be constructed in accordance with the present invention by simply varying the number and size of the support segments and other components.

Figure 8:
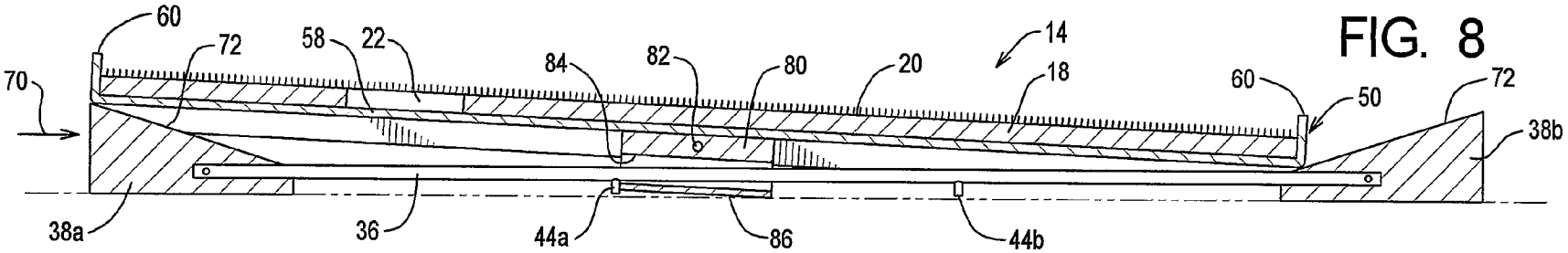
FIGS. 8-10 are cross-sectional views, similar to FIGS. 4-6, showing a second embodiment of the invention in which the center blocks of the segments are fixedly rather than pivotedly mounted to the tray portions thereof.
Figure 9:
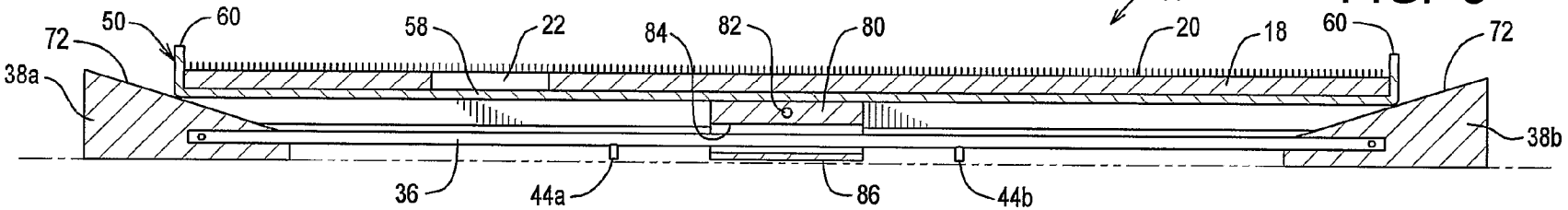
Figure 10:
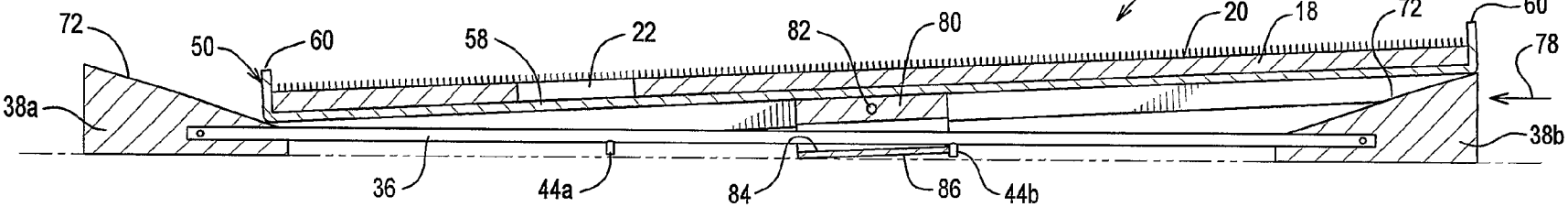

FIGS. 8-10 illustrate a second preferred embodiment of the present invention, this being identical in construction and operation to that described above except for the use of a center block 80 that is fixedly rather than pivotedly mounted to the underside of the tray member 50. In this embodiment, the center block is secured in the channel 64 on the underside of the tray member by a bolt or a pin 82, and has a vertically elongated bore 84 for accommodating motion of the rod member 36 as the tray member rocks from side-to-side. The bottom surface 86 of the center block is spaced slightly above the floor surface when in the neutral position in order to provide clearance for the edges of the block when the assembly is tilted, or the bottom of the block may be chamfered similar to the upper surface of the block 30 described above, so as to provide support at the center of the assembly in all positions. Similar to the block 30 described above, the stop pins 44*a*, 44*b* react with the sides of the block 80 to limit the range of motion of the assembly.

FIGS. 11-21C illustrate a third preferred embodiment of the present invention. As will be described below, the components of this embodiment differ in a number of respects from their counterparts described above. However, the overlying flexible layer or layers that form the putting surface (e.g., foam and carpet) are the same and are therefore not shown in the latter figures.

Figure 11:
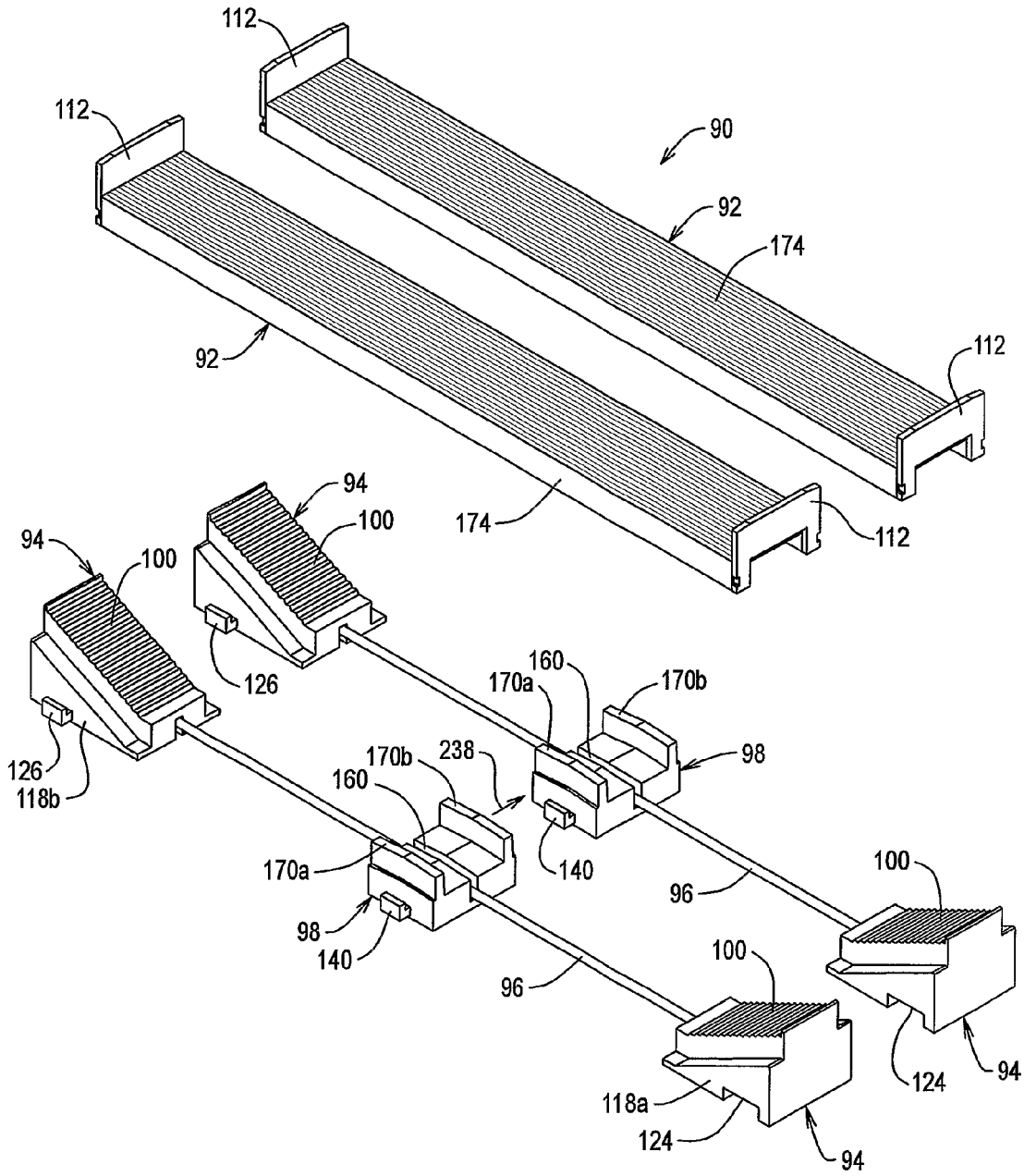
FIG. 11 is a perspective, exploded view of a pair of segments of a practice green assembly in accordance with a third embodiment of the present invention, showing the manner in which the components cooperate to form the articulated structure of the assembly.

As can be seen, the assembly 90 that is shown in FIG. 11 includes a plurality of tiltable tray sections 92, adjustable wedge members 94 that are joined in pairs by rod members 96, and center block members 98 through which the rod members extend in a transverse direction. As with the embodiments described above, these components cooperate to tilt the tray segments (and therefore the overlying playing surface) in one direction or the other, in response to the wedge members being displaced (pushed) in a transverse direction by the user.

Figure 12:
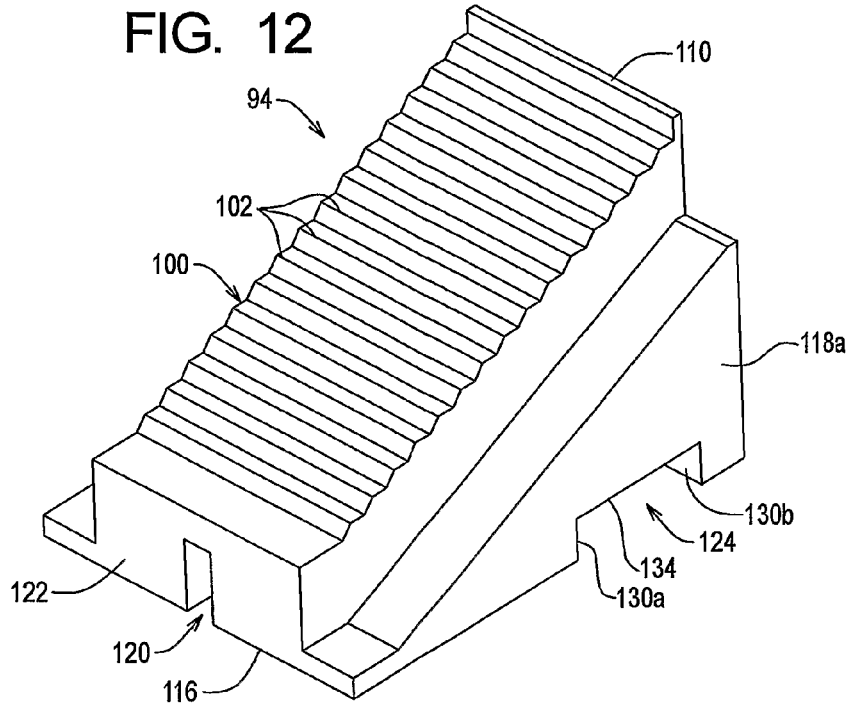
FIG. 12 is an upper perspective view of one of the wedge members of the practice green assembly of FIG. 11.
Figure 13:
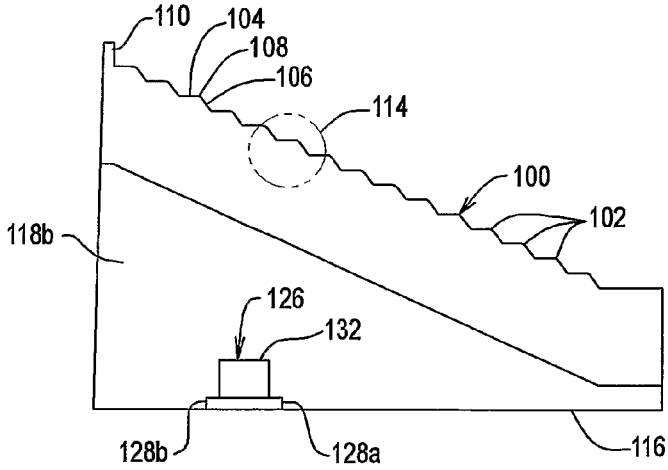
FIG. 13 is a side, elevational view of the wedge member of FIG. 12, showing the configuration thereof in greater detail, and in particular the stepped configuration of the sloped upper surface of the wedge member.

The wedge members 94 include stepped upper surfaces 100, rather than the smooth, planar upper surfaces of the wedge members described above. As can be seen in FIG. 12, the stepped surfaces 100 are formed by a series of relatively small individual steps 102; the illustrated embodiment suitably includes fifteen identical steps 102, each being approximately 13 mm wide. As can be seen in FIG. 13, each of the steps 102 is made up of a horizontal platform surface 104, and an angled ramp surface 106 that meets the platform surface in an obtuse angle at a ridge 108. The overall slope of surface 100 is suitably about 25 degrees, terminating at its upper end in an upwardly extending stop wall 110, the purpose of which will be described below.

During use of the putting green assembly, cooperating lower surfaces on the end cap members 112 (see FIG. 11) of the tray segments rest atop the platform surfaces 104 of the wedge members. This serves to stabilize the tray members against accidental shifting when subjected to a downward load, particularly when the upper playing surface is being walked upon by the user. The sloped ramp surfaces 106, in turn, allow the end cap members to side up/down the upper surfaces of the wedge members 94, from one platform surface to the next, in response to the wedge members being displaced in a transverse direction, thereby adjusting the angles of the tray segments 92 and overlying playing surface in the manner described above. In the preferred embodiment that is shown in the figures, the sloped surfaces are formed only on the steps 102, with the cooperating portion of the cap member having a vertically depending face that rides over the angled steps, but that comes up flat in face-to-face abutment against the stop wall 110 to limit inward movement of the wedge member and prevent the end cap from riding thereover. It will be understood, however, that in some embodiments an angled face or faces, corresponding to ramp surfaces 106, may be formed on the end cap members, in place of or addition to those on the stepped wedge surfaces.

Figure 14:
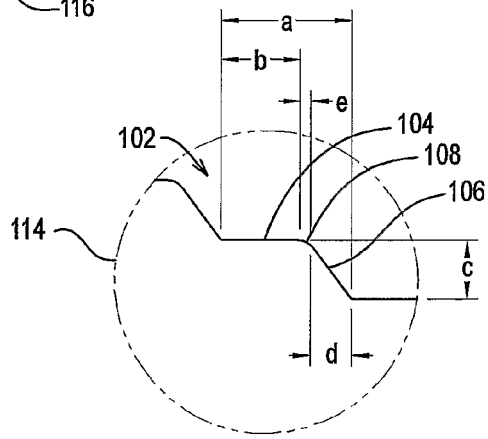
FIG. 14 is an enlarged, elevational view of one of the steps formed on the sloped upper surface of the wedge member of FIG. 13, showing the configuration thereof in greater detail.

FIG. 14 provides an enlarged view of one of the steps 102, in the area indicated by circle 114 in FIG. 13. In the illustrated embodiment, the sloped surfaces 106 are inclined at an angle of about 55 degrees, with the features of the steps having the exemplary dimensions set forth in the following table 1:

TABLE 1

| | |
|---|---|
| a | 13 mm |
| b | 8 mm |
| c | 6 mm |
| d | 4 mm |
| e | 1 mm |

It will by understood that the forgoing dimensions are provided by way of illustrating one example only, and may vary depending on of design factors.

As can be seen with further reference to FIGS. 12-13, the bottom sides of the wedge members 94 are provided with generally flat lower surfaces 116 that facilitate sliding movement in a longitudinal direction (i.e., in a direction transverse to the length of the playing path), over a floor or surface. First and second side surfaces 118*a*, 118*b*, in turn, engage the corresponding surfaces of adjacent wedge members, to provide bearing surfaces that again permit the wedge members to slide in a longitudinal/transverse direction but prevent them from shifting in a lateral, side-to-side direction.

As can be seen in FIG. 12, a longitudinal slot 120 extends upwardly from bottom surface 116, at the inboard end 122 of the wedge member. The slot receives an end of the rod member 96 (see FIG. 11), which secured to the wedge member by screws (not shown) or by other suitable means.

A second, laterally facing opening 124 is formed in a first side wall 118*a* of the wedge member. As can be seen in FIG. 12, this opening is also open to the bottom, i.e., it extends upwardly from the bottom side 116 of the wedge member. A cooperating tab or peg 126 projects from the second side wall 118*b*, in a location preferably directly opposite and centered on opening 124. Peg 126 is sized to be received in the opening 124 of an adjacent wedge member, and includes vertical contact faces 128*a*, 128*b* at its edges that react against forward and rearward end walls 130*a*, 130*b* of the opening (see FIG. 12) to act as stops that limit relative motion between the adjacent wedge members. Inasmuch as the width of the peg is less than the length of the slot, the adjacent wedge members are free to move relative to one another by only a predetermined distance (suitably about 52 cm in the illustrated example). This arrangement provides the advantage that the uses needs to displace (push) only one of the wedges with his foot, and the wedges on either side will then follow with incrementally smaller displacements to form a smoothly contoured slope; fine adjustments of the slope, if desired, can then be made the running the edge of the foot along the ends of the wedges as described above.

The distal end of the peg 124, in turn, includes an upwardly projecting flange portion 132 that fits behind a depending lip portion 134 of the opening 124, in the manner of a hook, so as to permit the wedge member to slide back and forth longitudinally as described while preventing the wedge members from being pulled apart and separated in a lateral direction.

Figure 15:
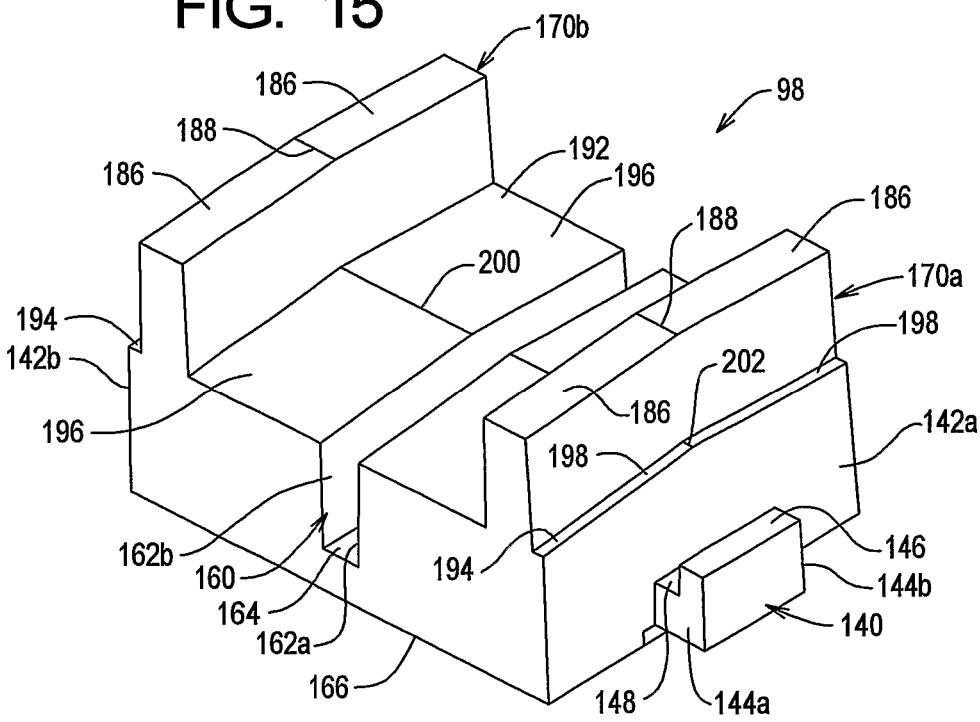
FIG. 15 is a perspective view of one of the center support members of the putting green assembly of FIG. 11, showing the features thereof in greater detail.
Figure 16:
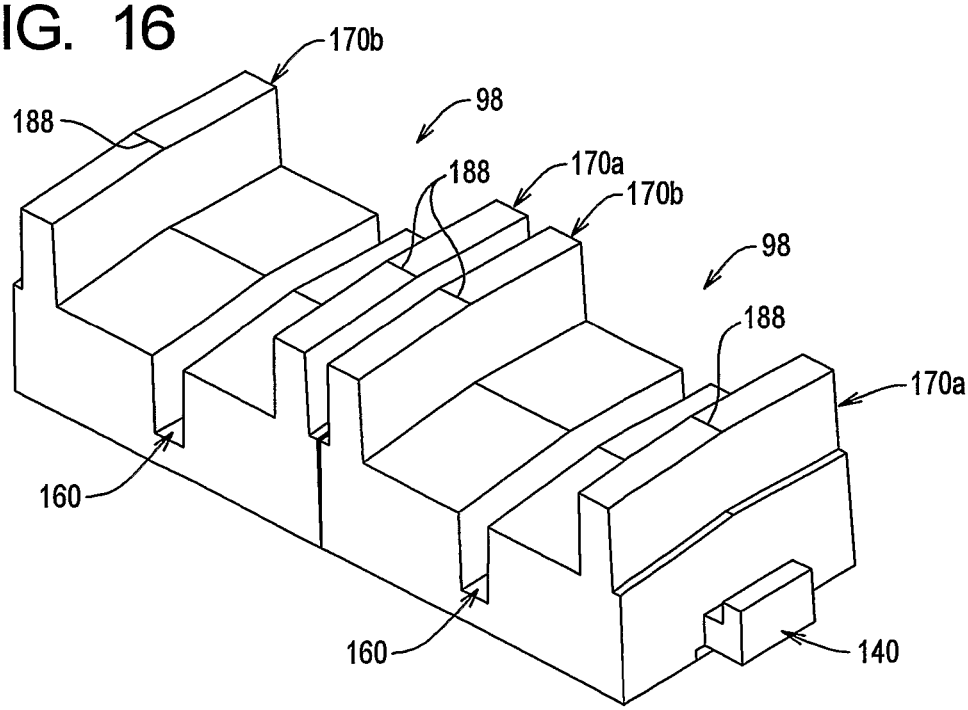
FIG. 16 is a perspective view, similar to FIG. 15, showing the manner in which the center support links to an adjoining, identical center block to construct a segmented series of center supports over the length of the putting green assembly.
Figure 17:
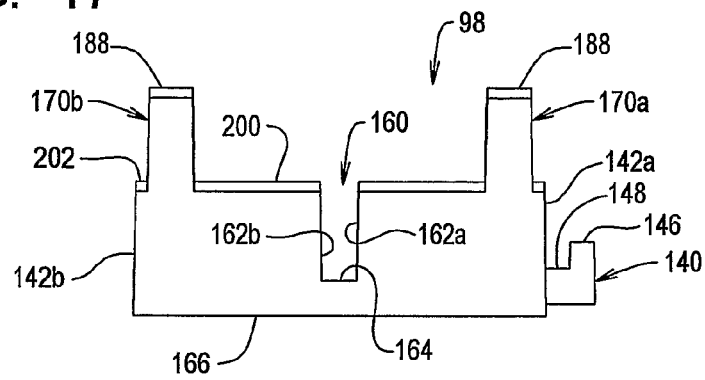
FIG. 17 is a side, elevational view of the center support of FIG. 15.
Figure 18:
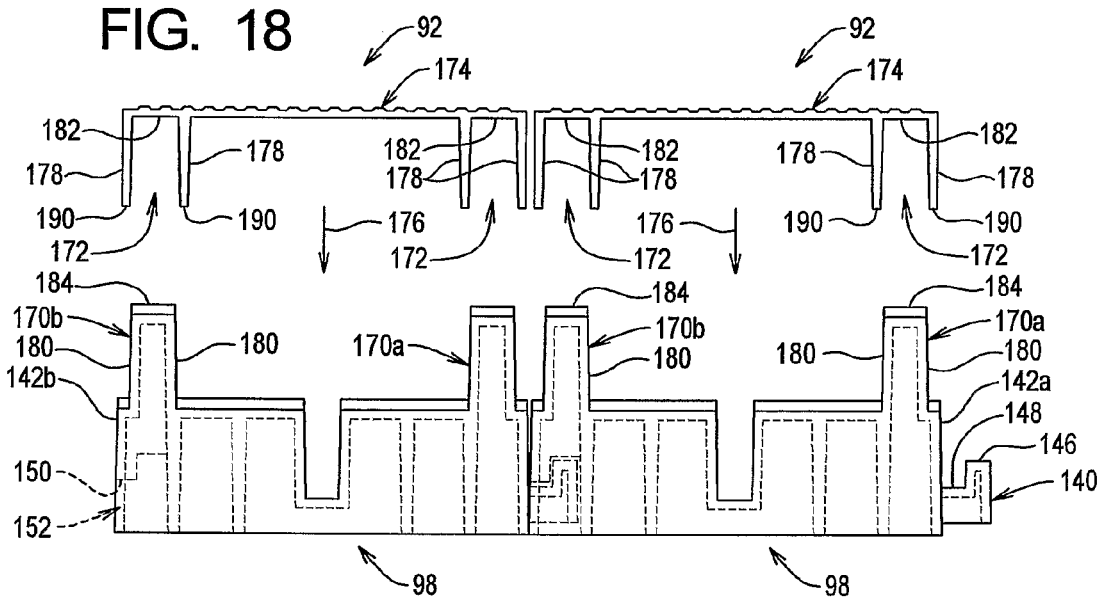
FIG. 18 is a side, cross-sectional view of the joined center supports of FIG. 16, together with a pair of the overlying panel segments of the putting green assembly.

As can be seen in FIG. 15, the center blocks 98 include an interlocking structure that enables them to be joined together, having a locking peg 140 formed one of the side walls 142*a*, 142*b* and a receiver opening (not shown in FIG. 15) formed in the other. The peg 140 includes first and second side walls 144*a*, 144*b* that extend generally normal to the side wall 142*a*, and an upwardly projecting flange 146 on its distal end that defines a locking notch 148. As can be seen in FIG. 18, the locking notch receives a depending lip 150 of the receiver opening 152, which is formed in the opposite side wall 142*b* of the center blocks, thus securing the blocks together laterally in a manner similar in that described above. Unlike the wedge members, however, the male plug and female receiver opening are approximately equal in width, thus eliminating any movement in a transverse direction. At the same time, the side walls 142*a*, 142*b* of adjacent blocks meet in a close fitting, face-to-face abutment that prevents the row from bending. These features therefore enable the blocks to be mounted as shown in FIGS. 16 and 18, to form a stable row of supports of any desired length down the centerline of the putting green assembly.

The cooperating pegs and receiver opening provide a strong and effective form of connection between the blocks and wedge members. It will be understood, however, that in some embodiments other forms of male/female connectors or other attachment features or structures may be utilized to link the members together in their respective rows.

As can be seen with further reference to FIGS. 15-18, each of the center blocks includes a downwardly extending, channel-shaped guide slot 160 that receives one of the transversely extending rod members 96; the spacing between the vertical side walls 162*a*, 162*b* of the guide slot, and the height of the horizontal bottom wall 164, permit the bar member to slide freely therethrough, while at the same time engaging the sides of the bar member so as to stabilize and maintain it in the transverse orientation.

The bottom sides 166 of the center blocks are generally flat, so that they will rest on the floor or other underlying surface in generally the same plane as the bottom sides of the wedge members 94. The upper sides, turn, include pairs of upwardly projecting walls or flange portions 170*a*, 170*b*, that extend parallel to and are spaced outwardly from the centrally located guide slots 160. As can be seen in FIG. 18, the flange portions 170*a*, 170*b* fit into downwardly opening channels 172 on the lower sides of the panel members 174 of the tray segments 92, when the latter are lowered onto the center blocks in the direction indicated by arrows 176 in FIG. 18. In so doing, the depending side walls 178 of the channels 172 contact the side surfaces 180 of the flange portions 170*a*, 170*b* of the block members to hold the tray members in transverse alignment, while the horizontal top walls 182 of the channels come to rest atop the upper ends 184 of the flanges.

As can be seen in FIGS. 15-16, the upper edges 184 of the flange portions 170*a*, 170*b* are bi-planar, with first and second sloped surfaces 186 that meet at a centerline ridge 188. Similarly, the lower edges 190 of walls 178 rest on inboard and outboard shoulders 192, 194 that flank the lower edges of the flange portions 170*a*, 170*b*, both of these also having sloped surfaces 196, 198 that meet at centerline ridges 200, 202. As a result, the co-aligned ridges 188, 200 and 202 cooperate with the engagement areas on the bottom of the panel members to form supports on which the tray segments tilt/pivot in the manner of a fulcrum, with the sloped surfaces 186, 196, 198 providing clearance for the desired range of motion.

The low of block members, assembled as described, thus permits the tray segments to pivot as previously described while at the same time supporting the middle portions of the segments from flexing/bending under the weight of a person walking on the playing surface. Moreover, the need for a pivot pin or similar connecting piece between the blocks and tray segments is obviated.

Figure 19:
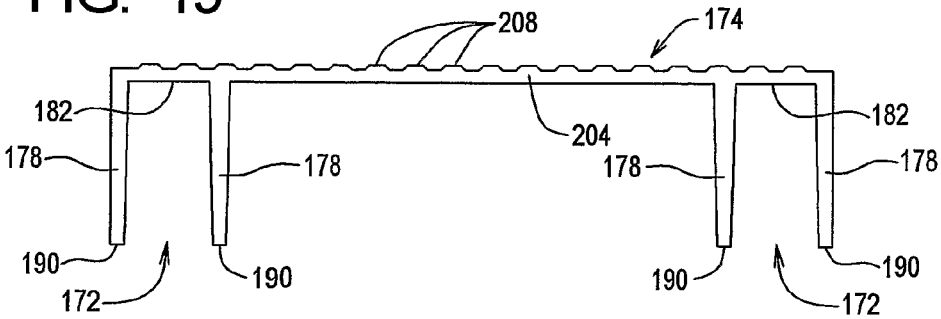
FIG. 19 is a cross-sectional view of one of the panel segments of FIG. 19, showing the configuration thereof in greater detail.
Figure 20:
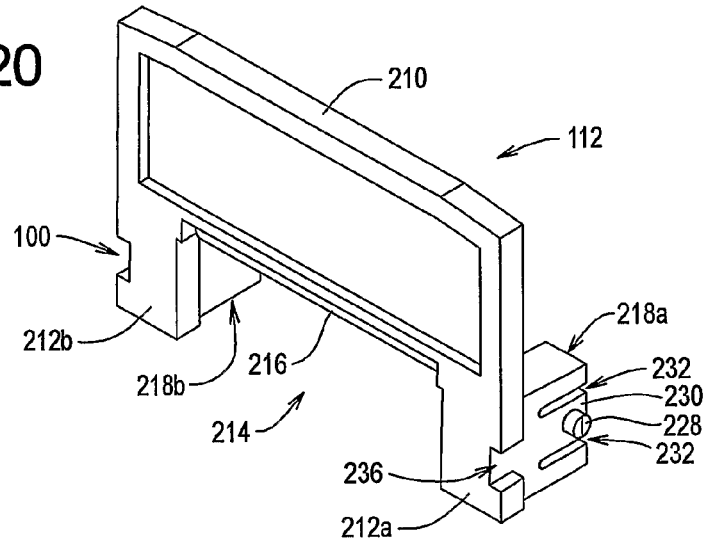
FIG. 20 is a perspective view of one of the end caps that mount in the ends of the panel segments to form the upstanding walls along the edges of the putting green assembly.
Figure 21A:
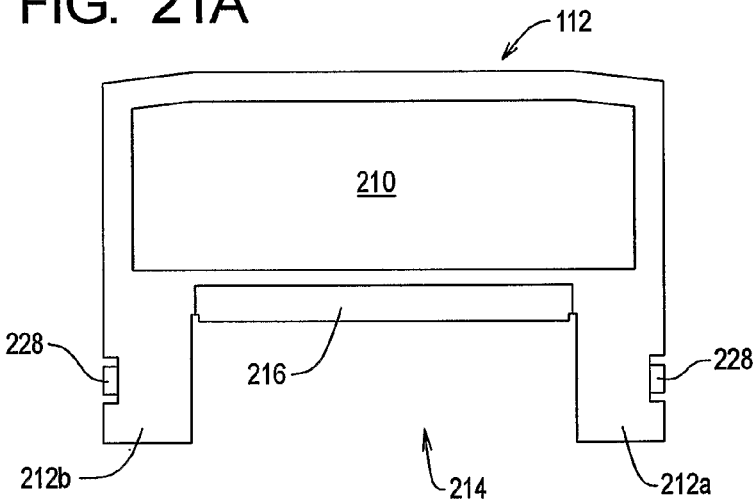
FIGS. 21A-21C are, respectively, front, side and rear elevational views of the end cap of FIG. 20.

As can be seen more clearly in FIG. 19, each panel member 174 is preferably formed as a single, unitary piece; suitably, the panel member is formed as an extrusion (e.g., extruded aluminum) having a continuous cross-section and cut to the desired length. The top wall 204 of the panel is provided with a series of raised ribs 208 that extend in a direction transverse to the length of the playing surface, which prevent the overlying flexible materials (e.g., foam/carpet) from slipping and/ or bunching up during use, for example, when the user is walking over the playing surface FIGS. 20-21C show the structure of the end cap members 112 that mount to the ends of the elongate panel members 114 in order to construct the pivotable tray segments 92. As can be seen, the end cap members each include a main, upwardly extending panel 210 that, in combination with its neighbors, forms the wall along the edge of the playing surface. First and second downward extensions 212*a*, 212*b* of the main panel define a downwardly facing U-shaped opening 214, the upper edge of which is spanned by a depending lip 216. The opening 214 is sized to fit over and receive the ramp portion of a wedge member 94, with the surface of the depending lip 216 engaging the stepped upper surface of the wedge member in the manner described above; as was also noted above, the outwardly facing wall of the depending lip 216 is vertical in the illustrated embodiment, but may be sloped depending on the configuration of the cooperating surfaces of the steps on the wedge member.

Figure 21B:
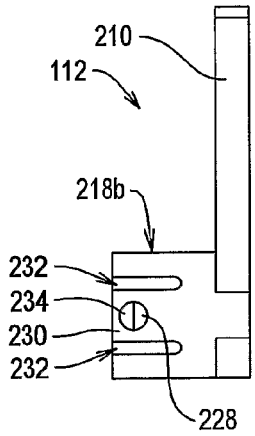
Figure 21C:
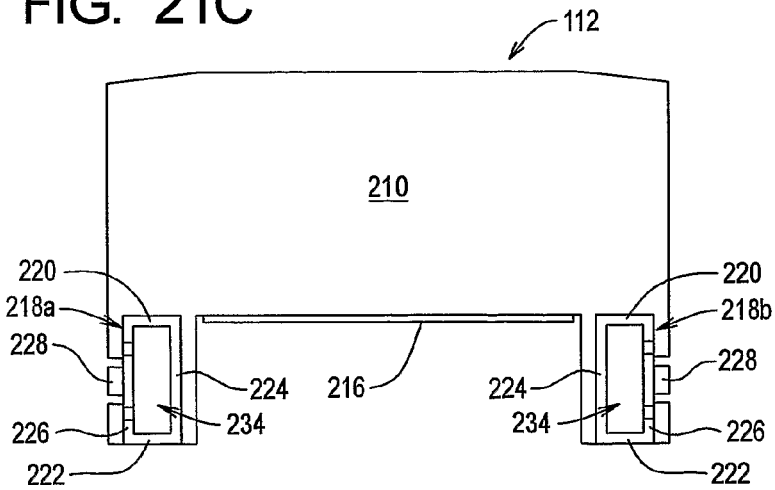

As can be seen with further reference to FIGS. 20-21C, first and second mounting legs 218*a*, 218*b* extend generally perpendicularly from extensions 212*a*, 212*b*, in a direction away from the outer face of the main panel 210. As is more clearly shown in FIG. 21C, the two mounting legs 218*a*, 218*b* have generally rectangular, box-shaped cross sections, formed by upper and lower walls 220, 222 and inner and outer walls 224, 226. The mounting legs are sized to be inserted endwise into the channels 172 of the panel members, with the height between the upper and lower walls 220, 222 of the legs being approximately equal to that of the channels. Relatively small, button-shaped studs 228 project from the outer walls 226 of the mounting legs, and in turn define (with inner walls 224) a width that is slightly greater than that of the channels 172. As is best seen in FIG. 21B, the studs 228 are formed on a portion 230 of the outer wall 226 that is flanked by upper and lower slots 232, so that area 230 is able to flex resiliently when displaced towards the hollow interior 234 of the leg. The distal ends of the studs 228 are in turn provided with inwardly beveled surfaces 234 on their leading sides.

These features permit the end caps 112 to be installed in the ends of the panel members of the tray segments, quickly and without using tools or fasteners, by simply pressing the two mounting legs into the ends of the channels 172. As this is done, the beveled faces 234 on the studs 228 contact and react against the inside surfaces of the walls 178, thus deflecting areas 230 and depressing studs so as to allow the legs to 218*a*, 218*b* to enter the channels. Once pressed into place, the non-beveled surfaces of the studs are biased into frictional engagement with the sides of the channels by the flexible wall portions 230, thus holding the end cap in place. Slots 236 along the outer sides of extensions 212*a*, 212*b* allow the end caps to be removed when desired, by simply inserting a screw driver or similar tool into the slots so as to push/pry the locking studs away from the walls of the channels.

The structure of the embodiment that is illustrated in FIGS. 11-21C thus provides a practice putting green that is not only simple to adjust and stable during use, but that can also be assembled/disassembled with ease and a minimum of tools: In order to install the assembly, the center blocks and wedge members (with rods attached) are simply hooked together in a row, as indicated by arrow 238 in FIG. 11. The end caps are snapped into the extruded panels to form the tray segments, which are then simply set atop the wedge members and center blocks, with the flange portions of the latter fitting into the channels in the bottom of the tray panels. The foam/carpet or other flexible material that forms the playing surface is then rolled out over the tray segments in order to complete the assembly. Disassembly is also rapid, and is essentially the reverse of the above steps.

It is to be recognized that various alterations, modifications, and/or additions may be introduced into the constructions and arrangements of parts described above without departing from the spirit or ambit of the present invention.

What is claimed is:

1. A practice putting green, comprising:

a plurality of transversely extending support segments arranged in side-by-side relationship so as to define an elongate playing path;

at least one flexible layer placed over said segments so as to form a playing surface along said playing path; and means for tilting said support segments individually in a direction substantially transverse to said playing path, so that said flexible layer that is supported thereby can be selectively raised or lowered from one side to the other so as to provide the playing path with a variety of contours, said means for tilting said support segments individually comprising:

a plurality of opposing wedge members having inwardly angled inclined surfaces that are in sliding engagement with opposite ends of said support segments.

2. The practice putting green of claim 1, wherein each of said support segments comprises:

a transversely extending tray member having an upper surface for supporting said overlying layer of resiliently flexible material.

3. The practice putting green of claim 1, wherein said wedge members comprise:

a plurality of steps formed on said inclined surfaces of said wedge members, said steps having substantially horizontal platform surfaces that engage cooperating surfaces on said ends of said support segments so as to hold said segments from slipping when under a vertical load.

4. The practice putting green of claim 3, wherein said steps further comprise:

angled ramps surfaces to intermediate said horizontal platform surfaces cooperate with surfaces on said ends of said support segments to allow said ends of said support segments to slide up and down between said horizontal platform surfaces in response to movement of said wedge members in a transverse direction.

5. The practice putting green of claim 1, wherein further comprising:

a plurality of transversely extending rod members having pairs of said wedge members mounted to ends thereof so that said pairs of wedge members will slide together simultaneously in response to pressure exerted on an outer end of one of said wedge members.

6. The practice putting green of claim 5, further comprising:

a plurality of center blocks mounted under said support segments, said center blocks having transversely extending openings for passage of said rod members therethrough.

7. The practice putting green of claim 6 wherein each said center block is fixedly mounted to an underside of a support segment and wherein said opening in said center block is vertically elongate so as to accommodate transverse rocking movement of said support segments relative to said rod member.

8. The practice putting green of claim 6, wherein said each center block is pivotedly mounted to said underside of a support segment so as to permit transverse rocking movement of said support member relative to said rod member.

9. The practice putting green of claim 6, wherein each said center block comprises:

at least one upwardly extending portion that contacts an underside of a support segment so as to permit transverse rocking movement of said support segment atop said center block.

10. The putting green of claim 9, wherein said upwardly extending portion of said center block comprises:

at least one upwardly extending flange portion that is received in a cooperating channel on said underside of said support segment.

11. The practice putting green of claim 2, wherein each of the said tray members comprises:

a narrow, substantially flat, transversely extending panel having upstanding wall portions at opposite ends that define a shallow, upwardly facing section of a channel, so that when placed in side-to-side relationship said tray members cooperate to define an elongate channel that receives said flexible layer therein.

12. The practice putting green of claim 11, wherein said at least one flexible layer comprises:

a layer of pliable material having a width selected so that first and second opposite edges of said layer fit closely within said upstanding walls at said ends of said tray members.

13. The practice putting green of claim 1, wherein said at least one flexible layer comprises:

a layer of resiliently flexible cushioning material; and a layer of carpet material overlying said layer of resiliently compressible cushioning material.

14. The practice putting green of claim 1 wherein said at least one flexible layer comprises:

a layer of resiliently flexible cushioning material; and a layer of artificial turf material overlying said layer of resiliently flexible cushioning material.

15. The practice putting green of claim 6, further comprising:

means for linking said plurality of center blocks together to from a lengthwise row of said blocks beneath said playing path.

16. The practice putting green of claim 15, wherein said means for linking said center blocks together comprises:

first and second mounting features formed on opposite sides of said center blocks for detachably mounting said center blocks together in side-by-side relationship.

17. The practice putting green of claim 15, further comprising:

means for linking said plurality of wedge members together to form first and second rows of said wedge numbers under opposite edges of said playing path.

18. The practice putting green of claim 17, wherein said means for linking said plurality of wedge members together further comprises:

means for limiting relative movement of adjacent wedge members in said rows to a predetermined distance.

19. The practice putting green of claim 18, wherein said means for linking said wedge members together comprises:

a male attachment feature on a first side of each wedge member and a female attachment feature on an opposite side of each wedge member that receives said male attachment feature in sliding engagement, said female attachment feature having first and second ends that react against said male attachment feature to form stops that limit relative movement of said attachment features to said predetermined distance.

20. The practice putting green of claim 19, wherein said male and female attachment features comprise:

a male peg having an upwardly projecting flange portion on its distal end; and a female slot having first and second ends and a depending lip portion that interfits with said flange portion of said peg so as to retain said peg in said slot while permitting said peg to slide lengthwise therein, said slot having a length greater than a width of said peg so as to permit said peg to slide said predetermined distance therein before contacting said ends of said slot.

* * * * *